US007185523B2

(12) United States Patent
Hauger

(10) Patent No.: US 7,185,523 B2
(45) Date of Patent: Mar. 6, 2007

(54) ROLLING PROCESS AND ROLLING SYSTEM FOR ROLLING METAL STRIP

(75) Inventor: Andreas Hauger, Attendorn (DE)

(73) Assignee: Muhr und Bender KG (DE)

( * ) Notice: Subject to any disclaimer, the term of this patent is extended or adjusted under 35 U.S.C. 154(b) by 161 days.

(21) Appl. No.: 10/817,084

(22) Filed: Apr. 2, 2004

(65) Prior Publication Data

US 2004/0255633 A1 Dec. 23, 2004

(30) Foreign Application Priority Data

Apr. 3, 2003 (DE) ..... 103 15 357

(51) Int. Cl.
*B21B 39/08* (2006.01)

(52) U.S. Cl. ..... 72/205; 72/161

(58) Field of Classification Search ..... 72/205, 72/146, 250, 161, 251
See application file for complete search history.

(56) References Cited

U.S. PATENT DOCUMENTS

| | | | | |
|---|---|---|---|---|
| 2,647,743 | A * | 8/1953 | Cook | 267/156 |
| 3,823,593 | A * | 7/1974 | Vydrin et al. | 72/205 |
| 2004/0177666 | A1 * | 9/2004 | Brockes et al. | 72/205 |

FOREIGN PATENT DOCUMENTS

| | | |
|---|---|---|
| DE | 100 532 | 10/1897 |
| DE | 30 24 682 A1 | 1/1982 |
| EP | 1 454 681 A2 | 9/2004 |
| GB | 1 545 114 | 5/1979 |
| JP | 62 89512 | 4/1987 |
| JP | 4 182017 | 6/1992 |
| JP | 4 182019 | 6/1992 |
| WO | WO 03/008122 A1 | 1/2003 |

* cited by examiner

*Primary Examiner*—Lowell A. Larson
*Assistant Examiner*—Debra Wolfe

(57) ABSTRACT

A metal strip rolling system (18), having a first reeling device (21) for reeling-off strip (18), a rolling stand (12) having at least two working rolls (13, 14) between which there is formed a roll gap (17) whose width is controllable, and a second reeling device (31) used for reeling-on strip (18) with a reduced strip thickness. A first strip storage assembly (23) having a plurality of rolls is positioned between the first reeling device (21) and the rolling stand (12), and a second strip storage assembly (33) having a plurality of rolls is positioned between the rolling stand (12) and the second reeling device (31). At least one of the strip storage assemblies (23, 33) is formed of a double roll assembly with strip being wrapped around two rolls (24, 25; 34, 35) in an S-like way, the rolls (24, 25; 34, 35) being arranged at different levels.

16 Claims, 2 Drawing Sheets

ROLLING PROCESS AND ROLLING SYSTEM FOR ROLLING METAL STRIP

BACKGROUND OF THE INVENTION

The invention relates to a process of hot or cold rolling metal strip, more particularly for flexibly rolling strip with a variable strip final thickness. The process uses a first reeling device for reeling-off purposes from which strip with a defined strip original thickness is unwound. The process further uses a rolling stand, more particularly a reversing stand which comprises at least two working rolls between which there is formed a roll gap whose width is controllable or regulatable. A second reeling device is used for reeling-on purposes on to which there is wound strip whose strip thickness is reduced relative to the defined strip original thickness. A first strip storage device including a plurality of rolls between the first reeling device and the rolling stand, and a second strip storage device including a plurality of rolls between the rolling stand and the second reeling device are also used. The rolls of the first and second strip storage devices for strip storage purposes are varied in their position relative to one another.

The invention also relates to a rolling system for hot or cold rolling metal strip, more particularly for flexibly rolling strip with a variable strip final thickness. The system includes a first reeling device for reeling-off purposes from which strip with a defined strip original thickness is unwound. The system also includes a rolling stand, more particularly a reversing stand which comprises at least two working rolls between which there is formed a roll gap whose width is controllable or regulatable. A second reeling device is used for reeling-on purposes on to which there is wound strip whose strip thickness is reduced relative to the defined strip original thickness. A first strip storage device is arranged between the first reeling device and the rolling stand and a second strip storage device is arranged between the rolling stand and the second reeling device. Such rolling systems are used to roll pre-rolled strip to a reduced final thickness which, with slight tolerances, can be set and maintained in the roll gap whose width is controllable and/or regulatable. The pre-rolled strip can be an already flexibly rolled strip with a variable strip original thickness.

The so-called flexible rolling process is used to produce metal strip with periodically changing, defined, different thicknesses. For example, the rolled longitudinal thickness profile, in respect of length and thickness, corresponds to the load to which a plate metal component is subsequently subjected. The rolling process should be a cold or hot rolling process. The strip material to be rolled is reeled off a coil, rolled and subsequently wound on under tension. The respective rolling systems can be reversing systems, i.e. after the strip of one coil has passed from a first to a second reeling device, the strip of the subsequent coil can be made to pass from the second to the first reeling device. After a suitable subsequent treatment, the strip material is used for producing individual sheet bar elements which, in turn, are used to produce components with different wall thicknesses. As a function of the required geometry, any plate deformation process can be applied for further processing, such as deep-drawing stretch-forming, internal high-pressure-deformation, and high-pressure sheet deformation, among others.

In the case of flexible rolling, it is possible to achieve considerable strip thickness differences of up to 50% in one single pass by varying the roll gap by servo-hydraulic or servo-electric setting mechanisms for the rolls. Changing the roll gap changes the thickness of the running-out end of the strip. Changing the roll gap from the condition of a constant volume, also results in changes in the strip speed at the running-in end and at the running-out end. These changes in the strip speed occur so quickly—for instance within 100 ms—that the groups of reels are unable to observe a constant strip tension at the roll gap. Any changes in the strip tension directly influence the strip thickness tolerances at the running-out end. To improve the strip thickness tolerances, it is therefore necessary to provide a process which permits a constant strip tension even while greatly changing strip speeds occur. For this purpose, it has been common practice for decades to use so-called "dancers" in the pass line which, having the function of strip storage devices, keep the strip tension constant if changes in speed occur.

WO 03/008122 A1 or DE 100 532 A1 also propose cold rolling systems by means of which hot rolled strip with a substantially constant strip original thickness with greater tolerances can be cold-rolled to periodically variable strip thicknesses within smaller tolerances, with the strip thickness commonly being set so as to periodically vary between two different values. In general, rolling systems of this type require first strip storage device to be arranged between the reeling device and the rolling stand and second strip storage device to be arranged between the rolling stand and the reeling device. These devices in the form of "dancers" substantially serve to maintain an approximately constant tensile load at the roll gap. Furthermore, when rolling strip with a periodically changing strip thickness, the strip storage device serves to balance the strip speeds which vary to a considerable extent at the input end and to a lesser extent at the output end, with the reeling speeds at the reels remaining substantially constant because with a constant original thickness and a changing final thickness of the strip material, the entry speed of the strip material at the roll gap changes erratically.

When winding up strip material with a periodically changing strip thickness, there occur special problems. After having been rolled, the wound-up strip material is annealed in the wound-up condition, and it has been found that strip material with a periodically changing strip thickness wound up under too high a tension—with such strip material naturally not being wound up on the reel in a completely planar way—can no longer be unwound in a problem-free way after having been annealed and after having cooled down. To date, this has meant that the wound-up strip material with a periodically changing strip thickness, after having been rolled and prior to being annealed, first has to be re-wound in a tension-free way to permit annealing in the wound-up condition without adversely affecting a problem-free unwinding operation.

So far, the strip storage mechanism in the positions as given within the rolling system, were provided in the form of dancing roll assemblies which each comprise two fixed deflecting rolls and one dancing roll which is controlled so as to be movable perpendicularly relative to the pass line. Because of the angle of wrap occurring in such cases, assemblies of said type cannot always ensure the required tensile forces for great changes in thickness. In addition, such dancing roll assemblies require a relatively long length of the rolling system and the rolling table.

From DE 302 46 82 A1, there is known a skin pass stand with tension rolls embraced by rolled strip in an S-like way, wherein the tension rolls can be driven by regulatable driving moments or they can be disconnected from their drives in order to serve entirely as deflecting rolls.

In order to facilitate the introduction of strip ends, more particularly very stiff strip from a thickness of 2–3 mm onwards, one of the tension rolls is pivotable around the other tension roll on its opposite side, and after completion of the running-in operation, it can be returned into its operating position. The drives of the pivotable tension rolls are fixed in position, so that, in operation, said tension rollers have to be fixed into position and locked. The tension rolls thus cannot function as strip storage devices.

Thus, there exits a need for a rolling process and a rolling system of said type which permits strip storage devices with a short length along the pass line. It would also be desirable to provide a rolling process and a rolling system of said type wherein the strip storage device is suitable for building up a high strip tension.

SUMMARY OF THE INVENTION

The present invention provides a process wherein the metal strip is guided over at least one of the strip storage devices in the form of an "S" wherein, in the course of the rolling process, as a result of a controlled or regulated movement, at least one of the rolls of the strip storage device distorts the "S" in such a way that the length of the metal strip between running into and, respectively, running out of the strip storage device is changed. More particularly, the metal strip can be guided over the strip storage device in the form of an upright "S" with arches lying on different heights, especially with arches which at least partially overlap in the horizontal direction, i.e. in a vertical projection. The length can be shortened further if, during the movement of the rolls, the centers of the arches of the "S" superimposed on one another are at least temporarily positioned one above the other so as to correspond to one another in the vertical direction.

The term "S" used herein includes an "S" mirrored in a vertical plane. The "S" comprises two arches (partially circular arches) with opposed curvatures which are connected to one another by a tangentially adjoining straight line.

According to a first advantageous embodiment of the process, the position of the upper arch of the "S" is changed in a controlled or regulated way, more particularly if an interference in strip speed originates from the roll gap. This is the case if flexible rolling with a variable strip thickness takes place. According to an alternative embodiment of the process, the position of the lower arch of the "S" is changed in a controlled or regulated way, more particularly if an interference in speed originates from the reeling device. Such a speed interference can be caused by the so-called "end edge impact" i.e. a stepped change in diameter at the coil radially above the inner front end of the strip material.

An inventive rolling system is provided wherein at least one of the strip storage devices is formed of a double-roll assembly wherein the strip is wrapped around two rolls whose axes are arranged at different levels. A first roll tensions the strip between the double roll assembly and the rolling stand and a second roll tensions the strip between the double roll assembly and the respective reeling device. Further, as a result of a movement of at least a movable one of the two rolls, the length of the piece of strip between the reeling device and the second roll and/or between the second roll and the first roll can be varied during the rolling process. In operation, the movable roll can be movable perpendicularly relative to the pass line or parallel to the pass line or it can be arranged so as to oscillate around an axis of rotation which is positioned outside the cross-section of the roll, more particularly on the axis of rotation of the second roll. The assembly with two rolls of the strip storage device arranged one above the other, as proposed here, on the one hand allows an axially short design and on the other hand, it allows the rolls to be wrapped around extensively, with the latter allowing a high strip tension at the roll gap. In one embodiment, the strip storage device comprises only these two rolls arranged one above the other. Preference is given to a substantially symmetric design of the strip storage device wherein an inventive double roll assembly is used both in front of the rolling stand and behind the rolling stand. The movable rolls can be set by suitable servo-hydraulic or servo-electric setting mechanisms which maintain high tensile forces at short reaction times. When varying the respective strip end thickness, i.e. when varying the roll gap setting, there should be set a constant strip tensile force without the inventive double-roll assembly having any oscillation effects and without there occurring any considerable delays in terms of time.

According to a first embodiment, the movable roll can be arranged above a further roll, more particularly if an interference in the strip speed originates from the roll gap, i.e. with flexible rolling, as mentioned above. In this case, the strip runs in at the first strip storage device at the further roll and runs out at the movable roll; and, in the second strip storage device, it runs in at the movable roll and out at the further roll.

According to a further embodiment, a movable roll can be arranged underneath a further roll, more particularly if an interference in the strip speed is caused by the "end edge impact." In this case, in the first strip storage device, the strip runs in at the movable roll and out at the further roll; whereas in the case of the second strip storage device, the strip runs in at the further roll and out at the movable roll.

For the purpose of introducing the front end of a strip from the unreeling device into the roll gap and from there into the reeling device, the respective lower roll can be designed to pivot from an operating position into an introducing position to the opposite side of the pass line, i.e. to a region above the pass line. After the front end of the strip has been fixed on the reeling device, the respective lower roll can be pivoted back into its operating position, with the strip then being pulled S-like around the pivotable lower roll and the substantially fixed upper roll. Unwinding the strip from the unreeling device and winding the strip on to the reeling device can preferably be effected via the underside of the reels. This makes it possible for the operator, at the same time, to monitor the strip on both sides of the strip. Unwinding and winding can also take place via the upper side of the reels, for example in order to advantageously affect the angle of wrap at the strip storage device.

A further embodiment provides a process of the initially mentioned type wherein, for the purpose of increasing the tension, at least one roll of the first strip storage device is braked at the roll gap by a braking moment variable in a controlled or regulatable way. For the purpose of increasing the tension, at least one roll of the second strip storage device is driven at the roll gap by a driving moment variable in a controlled or regulatable way. These strip storage devices allow the strip tension at the roll gap to be increased considerably, whereas it is possible to reduce the braking and driving moments respectively at the reels, which in rolling systems according to the state of the art are decisive for building up strip tensile forces. In absolute terms, it is possible to increase the strip tension at the roll gap.

According to a further advantageous embodiment, when rolling strip with a variable strip thickness, the braking moment of the roll of the first strip storage device and the driving moment of the roll of the second strip storage device are controlled or regulated to achieve a constant strip tension. Furthermore, it is possible for the control or regulation of the strip tension to be effected by changing the braking moment at several rolls of the first strip storage device and/or by changing the driving moment at several rolls of the second strip storage device. A further embodiment provides that the control and/or regulation of the strip tension is additionally effected by changing the relative position of the rolls of the first strip storage device and/or the relative position of the rolls of the second strip storage device.

An advantageous embodiment provides that at least one roll of the first strip storage assembly is connected to device for generating variable braking moments by being controlled and/or regulated, and at least one roll of the second strip storage device is connected to means for generating variable driving moments by being controlled and/or regulated. In this way it is possible to increase the tension, i.e. to increase the tension of the strip between the reel and roll gap at the input end and at the output end. This differs from dancing roll assemblies according to the state of the art, wherein only the relative roll positions are force-regulated and adjusted to maintain a constant strip tension, but otherwise the rolls rotate freely.

According to a further embodiment, the means for generating the braking moments or the means for generating the driving moments are formed by electrical machinery (generators, electric motors). Alternatively, the means for generating the braking moments or the means for generating the driving moments are formed by hydrostatic machinery (hydro-pumps/hydro-motors).

In another embodiment, two rollers of the inventive strip storage and strip tensioning devices as well as the working rolls and reels are drivable. For this purpose, the inventive double roll assembly in front of the rolling stand builds up a braking moment relative to the working rolls, with an inventive double roll assembly behind the rolling stand building up a driving moment relative to the working rolls.

In yet another embodiment, further freely rotating rolls and further brakable and, respectively, drivable rolls can be arranged directly in front of or behind the strip storage device. One roll for measuring the strip tension can be supported via a load cell at a fixed web, with the measured value of the load cell being used as an input value for setting a constant strip tension at the roll gap.

Between the individual above-mentioned components in the form of reeling devices, strip storage and strip tensioning devices and rolling stand, further components of the system can be provided in the form of roller tables or the like for guiding the strip along the pass line.

Other advantages and features of the invention will become apparent to one of skill in the art upon reading the following detailed description with reference to the drawings illustrating features of the invention by way of example.

BRIEF DESCRIPTION OF THE DRAWINGS

For a more complete understanding of this invention, reference should now be made to the embodiments illustrated in greater detail in the accompanying drawings and described below by way of examples of the invention.

In the drawings.

DETAILED DESCRIPTION OF THE DRAWINGS

Figure 1:
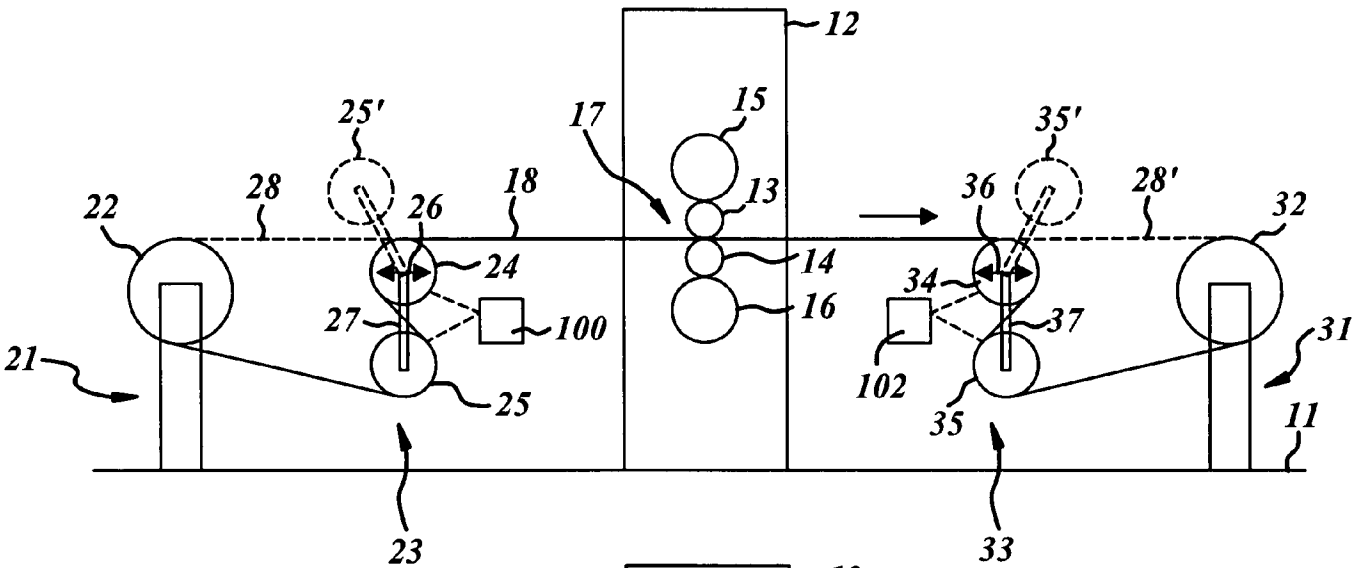
FIG. 1 shows the principles of a first embodiment of an inventive rolling system in a side view.

FIG. 1 shows an inventive rolling system in a first embodiment. A foundation 11 is used for erecting a rolling stand 12 showing two working rolls 13, 14 arranged one above the other and two supporting rolls 15, 16 aligned vertically relative to the rolls 13, 14. Between the working rolls 13, 14 there is provided a settable and/or controllable roll gap 17 through which there passes a metal strip 18 from left to right. The strip 18 originates from a first reeling device 21 from whose reel 22 rotating counter-clockwise the strip 18 is unwound via the underside. From the reeling device 21, the strip 18 runs into a strip storage assembly 23 with a strip storage and tension-increasing function contained in a double roll assembly including a movable upper roll 24 and a fixed lower roll 25. A horizontal double arrow 26 indicates that the movable roll 24 can be horizontally displaced in a controlled way in the device 23. In the embodiment shown here, a movement of the movable roll 24 changes the length of the piece of strip between the movable roll 24 and the roll gap 17 and also the length of the piece of strip between the movable roll 24 and the fixed roll 25. The lower roll 25, which is fixed, is pivoted by means of a rocker arm 27 from its operating position (25) into an introducing position (25') above the pass line 28. Dashed lines indicate the introducing position (25') of the lower roll 25 in which the strip 18 can be introduced into the rolling stand 12 along the pass line 28 which is also indicated by dashed lines. Only when the strip 18 is fixed in the strip storage assembly 33 for winding-up purposes, does the roll 25 pivot back into its operating position 25 indicated by continuous lines.

In the direction of production behind the stand 12 and thus to the right of the stand, there is shown a second reeling device 31 on whose reel 32 rotating anti-clockwise the rolled strip 18 is wound up via the underside. Between the stand 12 and the device 31, there is positioned a further strip storage assembly 33 having a strip storing and tension-increasing function contained in a double roll assembly including a movable upper roll 34 and a fixed lower roll 35. As indicated by the horizontal double arrow 36, the movable roll 34 is displaceable relative to the fixed roll 35 in the device 33 in a controlled way. As a result, the length of the piece of strip between the movable roll 34 and the fixed roll 35 and also the length of the piece of strip between the movable roll 34 and the roll gap 17 changes simultaneously. Dashed lines indicate the pivot movement of the roll 35, generated by the rocker arm 37, from its operating position (35) via the pass line 28' into an introducing position (35') which serves to introduce the front end of the strip along the pass line 28' which is again shown in the form of a dashed line. When the start of the strip is fixed on the reel 32, the roll 35 pivots back into its operating position (35) shown in the form of a continuous line. Apart from the possibilities of moving the movable rollers 24, 34 illustrated here, other movements are conceivable, as will be shown in FIG. 2.

The above-mentioned tension-increasing function is achieved if at least one of the rolls 24, 25 is connected to and operated by a braking mechanism (100) and if at least one of the rolls 34, 35 is connected to and operated by a driving mechanism (102).

Figure 2:
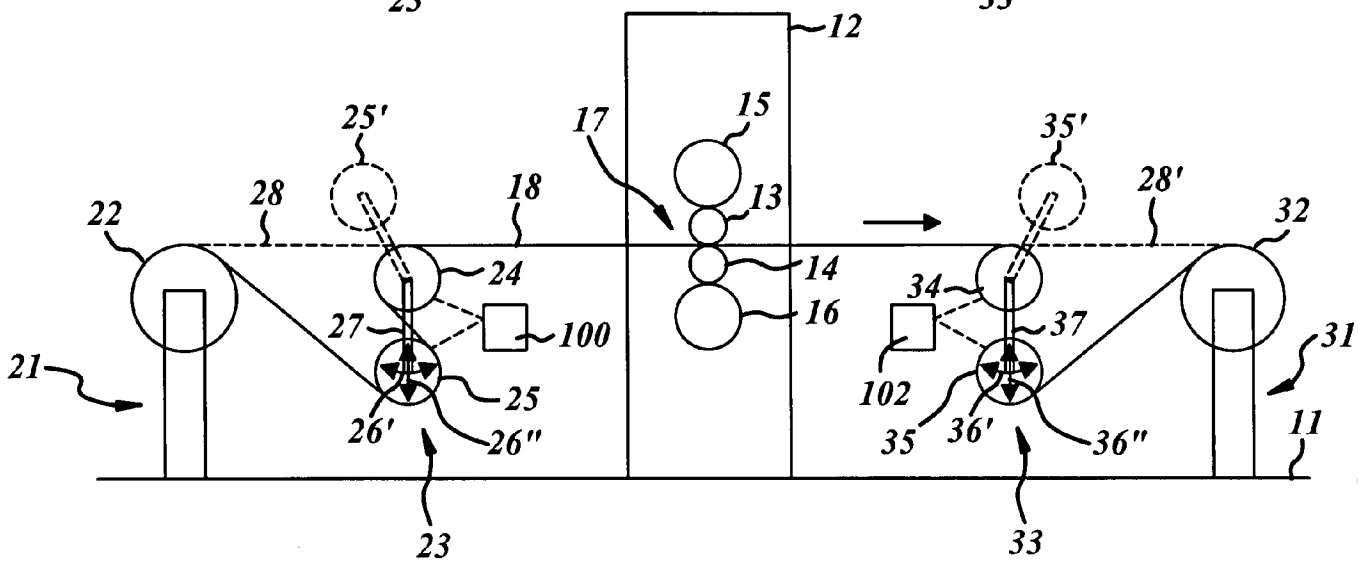
FIG. 2 shows the principles of a second embodiment of an inventive rolling system in a side view.

FIG. 2 shows an inventive rolling system in a second embodiment. A foundation 11 is used for erecting a rolling stand 12 showing two working rolls 13, 14 arranged one above the other and two supporting rolls 15, 16 aligned vertically relative to the rolls 13, 14. Between the working rolls 13, 14 there is provided a settable and/or controllable roll gap 17 through which there passes a metal strip 18 from left to right. The strip 18 originates from a first reeling device 21 from whose reel 22 rotating clockwise the strip 18 is unwound via the upper side. From the reeling device 21, the strip runs into a strip storage assembly 23 with a strip storing and tension-increasing function contained in a double roll assembly consisting of a fixed upper roll 24 and a movable lower roll 25. A circular-arch shaped double arrow 26' indicates that the movable roll 25 in the device 23 is able to pivot around the axis of the fixed roll 24. A vertical double arrow 26" indicates that, alternatively, the height of the movable roll 25 can be adjusted. In the embodiments shown here, a movement of the movable roll 25 changes at least the length of the piece of strip between the reel 22 and the movable roll 25; in the second case (26") it also changes the length of the piece of strip between the movable roll 25 and the fixed roll 24. The lower roll 25 is pivoted by a rocker arm 27 from its operating position (25) into an introducing position (25') above the pass line 28. Dashed lines indicate the introducing position (25') of the lower roll 25, in which introducing position (25') the strip 18 can be introduced into the rolling stand 12 along the pass line 28 which is also shown in the form of a dashed line. Only when the strip 18 is fixed in the strip storage assembly 33, does the roll 25 pivot back into its operating position (25) illustrated in continuous lines.

In the direction of production behind the stand 12 and thus to the right of the stand, there is shown a second reeling device 31 on whose reel 32 rotating clockwise the rolled strip 18 is wound up via the upper side. Between the stand 12 and the device 31, there is positioned a further strip storage assembly 33 with a strip storing and tension-increasing function contained in a double roll assembly comprising a fixed upper roll 34 and a movable lower roll 35. As indicated by a circular-arch-shaped double arrow 36', the movable roll 35 is pivotable approximately around the axis of the fixed roll 34. As indicated by the vertical double arrow 36", the movable roll 35 can alternatively or additionally be moved up and down. As a result, at least the length of the piece of strip between the movable roll 35 and the reel 32 changes, and in the second case (36"), the length of the piece of strip between the fixed roll 34 and the movable roll 35 also changes. Dashed lines indicate the pivot movement of the roll 35, generated by the rocker arm 37, from its operating position (35) above the pass line 28' into an introducing position (35') which serves for introducing a front end of the strip along the pass line 28' which is again shown in the form of a dashed line. When the start of the strip is fixed on the reel 32, the roll 35 pivots back into its operating position (35) shown in the form of a continuous line. Apart from the possibilities of moving the movable rolls 25, 35, in the operating position, a movement of the movable roll parallel to the pass line 28, i.e. in the horizontal direction, is also contemplated, as already shown in FIG. 1.

The above-mentioned tension-increasing function is achieved if at least one of the rolls 24, 25 is connected to and operated by a braking mechanism (100) and if at least one of the rolls 34, 35 is connected to and operated by a driving mechanism (102).

The more extensively the rolls 24, 25, 34, 35 are wrapped around by the strip 18, the greater the strip tensioning forces which can be built up by the strip storing and tension-increasing assemblies. The strip tensioning forces at the stand 12 and in the roll gap 17 should be high, whereas the reels 22, 32 should be relieved from tensile forces as much as possible. Further modifications are available to those versed in the art within the framework of the above disclosure.

Figure 3:
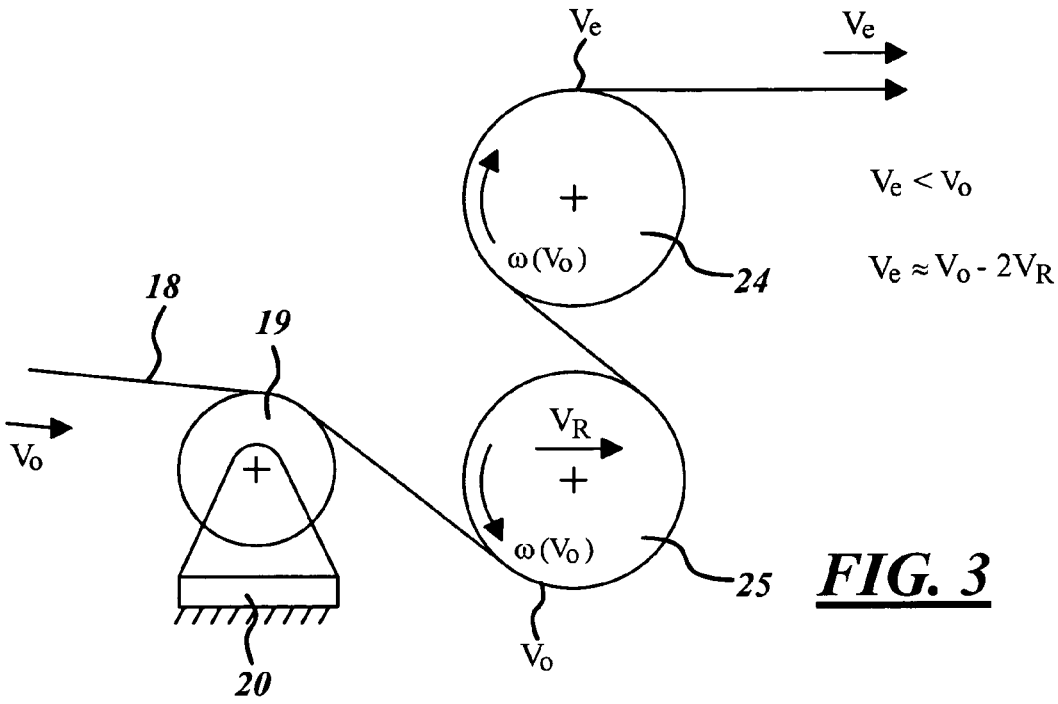
FIG. 3 shows a strip storage device at the input end in the form of a detail in a first embodiment.

FIG. 3 shows a strip storage device at the running-in end of the rolling stand 12 which is assumed to be on the right, having an upper roll 24 and a lower roll 25. In the embodiment shown here, the lower roll 25 is the movable roll. On the side of the unwinding device (assumed to be on the left), a further roll 19 is arranged in front of the roll 25, with the strip 18 being guided and deflected via said further roll 19. Via a load cell 20, the roll 19 is supported on a fixed web. When using said load cell 20, the roll is supported so as to be freely rotatable. However, the roll can also be connected to a mechanism for generating a controllable braking moment.

In a mirror-symmetrical reversal, the assembly as shown can also be used at the output end of the roll gap 17, in which case the roll 19 is optionally connected to controllable driving mechanism.

Figure 4:
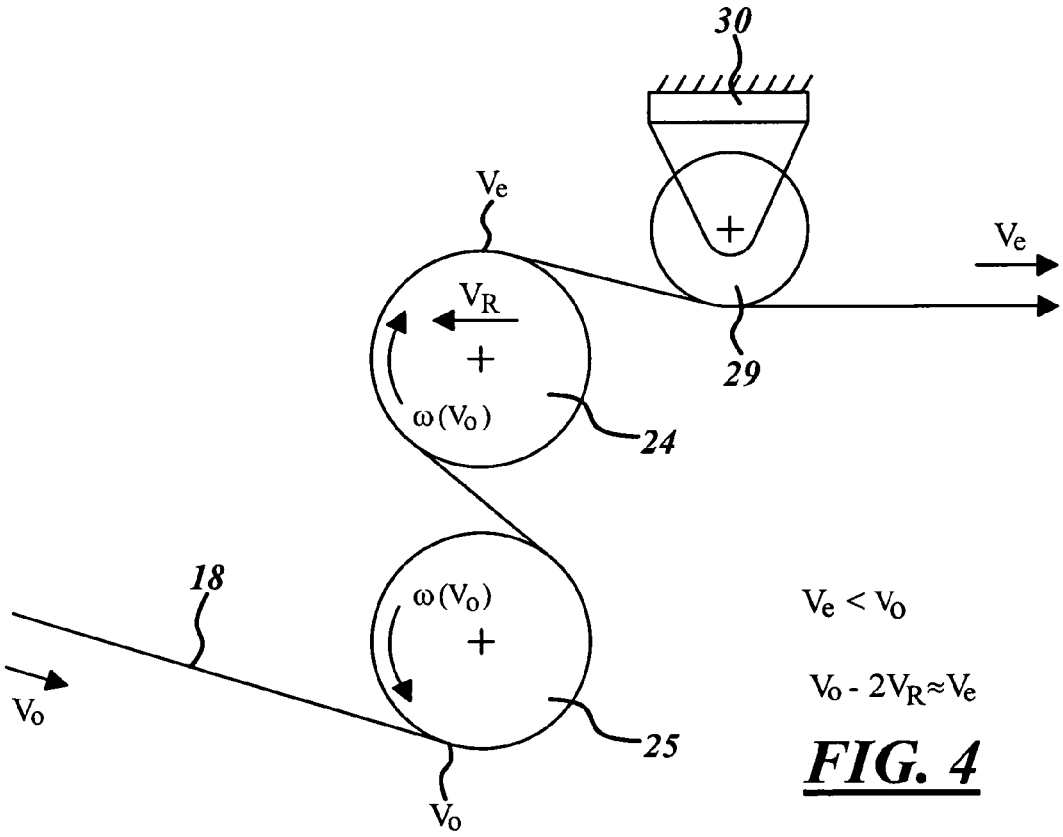
FIG. 4 shows a strip storage device at the input end in the form of a detail in a second embodiment.

FIG. 4 shows a strip storage device at the input end of the roll gap (assumed to be on the right), which comprises an upper roll 24 and a lower roll 25. In this configuration, the upper roll 24 is controllably movable. A further roll 29 supported via a load cell 30 on a fixed web adjoins the upper roll 24. The strip running off the roll 24 is deflected by the roll 29. In this case, too, the roll 29—when using a load cell 30—is freely rotatable. If a load cell is not used, the roll 29, too, can be provided with a device for generating a braking moment.

In a mirror-symmetrical reversal, the assembly as shown can also be used at the output end of the roll gap, in which case the roll 29 is optionally connected to controllable driving mechanism.

FIGS. 3 and 4 show the relations of the unwinding speed $V_o$, of the running speed $V_e$, and of the roll movement speed $V_R$ at constant rotational roll speeds $w(V_0)$in the course of one strip storing phase.

From the foregoing, it can be seen that there has been brought to the art a new and improved strip rolling method and system. While the invention has been described in connection with one or more embodiments, it should be understood that the invention is not limited to those embodiments. Thus, the invention covers all alternatives, modifications, and equivalents as may be included within the spirit and scope of the appended claims.

What is claimed is:

1. A process for hot or cold rolling metal strip (18) with a first reeling device (21) from which strip (18) with a defined strip original thickness is unwound, a rolling stand (12) comprising at least two working rolls (13, 14) between which there is formed a roll gap (17) whose width is controllable, a second reeling device (31) for reeling-on strip (18) whose strip thickness is reduced relative to the original strip thickness, a first strip storage assembly (23) comprising a plurality of rolls between the first reeling device (21) and the rolling stand (12), and a second strip storage assembly (33) comprising a plurality of rolls between the rolling stand (12) and the second reeling device (31), wherein the rolls of the first and second strip storage assemblies for strip storage purposes are varied in their position relative to one another, the process comprising the steps of;

guiding the metal strip (18) over at least one of the strip storage assemblies (23, 33) in the form of an "S," and in the course of the rolling process, controlling the movement of at least one of the rolls (24, 25, 34, 35) of the strip storage assembly (23, 33) to distort the "S" such that the length of the metal strip between running into and, respectively, running out of the strip storage assembly (23, 33) is varied, wherein the step of guiding includes guiding the metal strip (18) over the strip storage assembly (23, 33) in the form of an upright "S" with arches lying at different heights, and which at least partially overlap in a vertical projection.

2. A process according to claim 1, wherein, during the controlled movement of at least one of the rolls, the centers of the overlapping arches of the "S" overlap one another at least temporarily in the vertical direction.

3. A process according to claim 1, wherein during the controlled movement of at least one of the rolls, the position of the upper arch of the "S" is changed.

4. A process according to claim 1, wherein during the controlled movement of at least on of the rolls, the position of the lower arch of the "S" is changed.

5. A rolling system for hot or cold rolling metal strip (18) comprising:

a first reeling device (21) from which strip (18) with a defined strip original thickness is unwound;

a rolling stand (12) having at least two working rolls (13, 14) between which there is formed a roll gap (17) whose width is controllable;

a second reeling device (31) for reeling-on strip (18) whose strip thickness is reduced to the original thickness;

a first strip storage assembly (23) comprising a plurality of rolls located between the first reeling device (21) and the rolling stand (12); and a second strip storage assembly (33) comprising a plurality of rolls located between the rolling stand (12) and the second reeling device (31), wherein at least one of the strip storage assembly (23, 33) is a double-roll assembly wherein the strip (18) is wrapped in an S-like way around two rolls (24, 25; 34, 35) whose axes are arranged at different levels, wherein a first roll (24, 34) tensions the strip (18) between the double roll assembly (23, 33) and the rolling stand (12) and wherein a second roll (25, 35) tensions the strip (18) between the double roll assembly (23, 33) and the respective reeling device (21, 31) and wherein, as a result of a movement of at least one movable roll (24, 34; 25, 35), the length of the piece of strip between the reeling device (21, 31) and the second roll (25, 35) or between a second roll (25, 35) and the first roll (24, 34) can be varied during the rolling process, and wherein the rolls of the strip storage assemblies (23, 33) at least partially overlap in a vertical projection.

6. A rolling system according to claim 5, wherein the axes of the rolls of the strip storage assemblies (23, 33), when moving, are at least temporarily positioned one above the other.

7. A rolling system for hot or cold rolling metal strip (18) comprising:

a first reeling device (21) from which strip (18) with a defined strip original thickness is unwound;

a rolling stand (12) having at least two working rolls (13, 14) between which there is formed a roll gap (17) whose width is controllable;

a second reeling device (31) for reeling-on strip (18) whose strip thickness is reduced relative to the original thickness;

a first strip storage assembly (23) comprising a plurality of rolls located between the first reeling device (21) and the rolling stand (12); and a second strip storage assembly (33) comprising a plurality of rolls located between the rolling stand (12) and the second reeling device (31), wherein at least one of the strip storage assembly (23, 33) is double-roll assembly wherein the strip (18) is wrapped in an S-like way around two rolls (24, 25; 34, 35) whose axes are arranged at different levels, wherein a first roll (24, 34) tensions the strip (18) between the double roll assembly (23, 33) and the rolling stand (12) and wherein a second roll (25, 35) tensions the strip (18) between the double roll assembly (23, 33) and the respective reeling device (21, 31) and wherein, as a result of a movement of at least one movable roll (24, 34; 25, 35), the length of the piece of strip between the reeling device (21, 31) and the second roll (25, 35) or between a second roll (25, 35) and the first roll (24, 34) can be varied during the rolling process, and wherein the strip storage assemblies (23, 33) each comprise a movable roll (24, 34) arranged above a further roll (25, 35), and wherein the strip material in the first strip storage assembly (23) runs in via the further roll (25) and runs out via the movable roll (24) and, in the second strip storage assembly (33), runs in via the movable roll (34) and runs out via the further roll (35).

8. A rolling system for hot or cold rolling metal strip (18) comprising:

a first reeling device (21) from which strip (18) with a defined strip original thickness is unwound;

a rolling stand (12) having at least two working rolls (13, 14) between which there is formed a roll gap (17) whose width is controllable;

a second reeling device (31) for reeling-on strip (18) whose strip thickness is reduced relative to the original thickness;

a first strip storage assembly (23) comprising a plurality of rolls located between the first reeling device (21) and the rolling stand (12); and a second strip storage assembly (33) comprising a plurality of rolls located between the rolling stand (12) and the second reeling device (31), wherein at least one of the strip storage assembly (23, 33) is a double-roll assembly wherein the strip (18) is wrapped in an S-like way around two rolls (24, 25; 34, 35) whose axes are arranged at different levels, wherein a first roll (24, 34) tensions the strip (18) between the double roll assembly (23, 33) and the rolling stand (12) and wherein a second roll (25, 35) tensions the strip (18) between the double roll assembly (23, 33) and the respective reeling device (21, 31) and wherein, as a result of a movement of at least one movable roll (24, 34, 25, 35) the length of the piece of strip between the reeling device (21, 31) and the second roll (25, 35) or between a second roll (25, 35) and the first roll (24, 34) can be varied during the rolling process, and wherein the strip storage assemblies (23, 33) each comprise a movable roll (25, 35) arranged underneath a further roll (24, 34), and wherein the strip material in the first strip storage assembly (23) runs in via the movable roll (25) and runs out via the further roll (24) and, in the second strip storage assembly (33), runs in via the further roll (34) and runs out via the movable roll (35).

9. A rolling system according to claim 7, wherein each movable roll (24, 34), in operation, is movable perpendicularly relative to a pass line (28).

10. A rolling system according to claim 8, wherein each moveable roll (25, 35), in operation, is movable perpendicularly relative to a pass line (28).

11. A rolling system according to claim 7, wherein each movable roll (24, 34), in operation, is movable parallel to a pass line (28).

12. A rolling system according to claim 8, wherein each movable roll (25, 35), in operation, is movable parallel to a pass line (28).

13. A rolling system according to claim 7, wherein each movable roll (24, 34) is arranged to oscillate around an axis of rotation of the respective further roll (25, 35).

14. A rolling system according to claim 8, wherein each movable roll (25, 35) is arranged to oscillate around an axis of rotation of the respective further roll (24, 34).

15. A rolling system according to claim 5, wherein the strip (18) runs off from an underside of the first reeling device (21).

16. A rolling system according to claim 5, wherein the strip (18) runs in on an underside of the second reeling device (31).

* * * * *

UNITED STATES PATENT AND TRADEMARK OFFICE

CERTIFICATE OF CORRECTION

PATENT NO. : 7,185,523 B2
APPLICATION NO. : 10/817084
DATED : March 6, 2007
INVENTOR(S) : Andreas Hauger It is certified that error appears in the above-identified patent and that said Letters Patent is hereby corrected as shown below:

In The Claims:
Claim 5, Column 9, Line 29, should read as follows:
-- whose strip thickness is reduced relative to the original thick- --

Claim 7, Column 10, Line 8, should read as follows:
-- is a double-roll assembly wherein the strip (18) is --

Claim 8, Column 10, Line 54, should read as follows:
-- 34; 25, 35), the length of the piece of strip between the --

Signed and Sealed this

Fifteenth Day of May, 2007

JON W. DUDAS
*Director of the United States Patent and Trademark Office*